US005857237A

United States Patent [19]

Dranginis

[11] Patent Number: 5,857,237

[45] Date of Patent: Jan. 12, 1999

[54] NOVELTY ICE SCRAPER

[76] Inventor: William M. Dranginis, 7823 Leland Rd., Manassas, Va. 20111-1944

[21] Appl. No.: 790,784

[22] Filed: Jan. 30, 1997

Related U.S. Application Data

[60] Provisional application No. 60/010,820 Jan. 30, 1996.

[51] Int. Cl.[6] ..... A47L 13/08

[52] U.S. Cl. ..... 15/236.02; 15/236.05; 15/236.08

[58] Field of Search ..... 15/236.01, 236.02, 15/236.05, 236.08; 30/169, 172; D32/46

[56] References Cited

U.S. PATENT DOCUMENTS

| | | | |
|---|---|---|---|
| D. 320,483 | 10/1991 | Desautel | D32/46 |
| D. 349,592 | 8/1994 | Stoll | D32/46 |
| D. 355,281 | 2/1995 | Hansen et al. | D32/46 |
| 4,275,476 | 6/1981 | Hopkins et al. . | |
| 4,418,439 | 12/1983 | Porchet . | |
| 4,468,831 | 9/1984 | Schneider . | |
| 4,546,513 | 10/1985 | Hammond . | |
| 4,712,269 | 12/1987 | Worthen . | |
| 4,719,660 | 1/1988 | Hopkins . | |
| 4,747,175 | 5/1988 | Durgin . | |
| 4,809,386 | 3/1989 | Re . | |
| 4,813,458 | 3/1989 | Jacobucci . | |
| 4,922,569 | 5/1990 | Brinker et al. . | |
| 5,099,540 | 3/1992 | Paschetto . | |
| 5,263,222 | 11/1993 | Johnstone, II . | |
| 5,418,998 | 5/1995 | Smarra . | |
| 5,445,420 | 8/1995 | Lairmore et al. . | |

FOREIGN PATENT DOCUMENTS

| | | | |
|---|---|---|---|
| 2436697 | 5/1980 | France | 15/236.02 |
| 3341529 | 5/1985 | Germany | 15/238.02 |

*Primary Examiner*—Terrence Till
*Attorney, Agent, or Firm*—James H. Meadows

[57] ABSTRACT

A novelty ice scraper has at least one beveled scraping edge and a serrated cutting edge. The device is about the size of a credit card but thicker to increase strength and durability. Preferably, the device is manufactured by laminating at least two plastic sheets together, cutting them to form, bevelling a scraping edge thereon, and providing a flattened tip along the beveled edges.

7 Claims, 2 Drawing Sheets

FIG. 2A
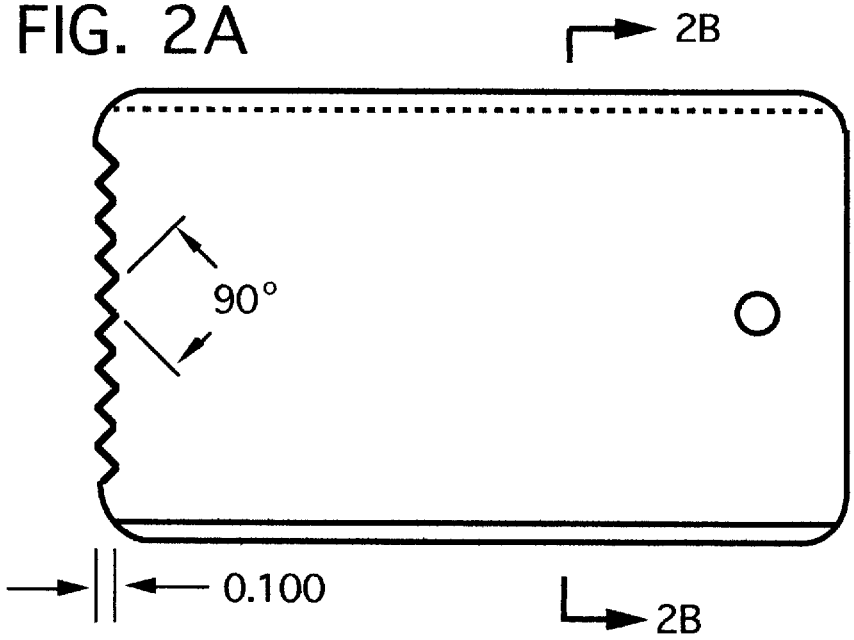
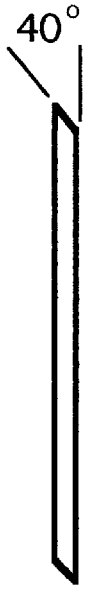
FIG. 2B
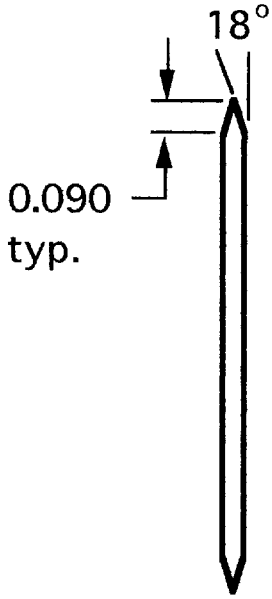
FIG. 2C
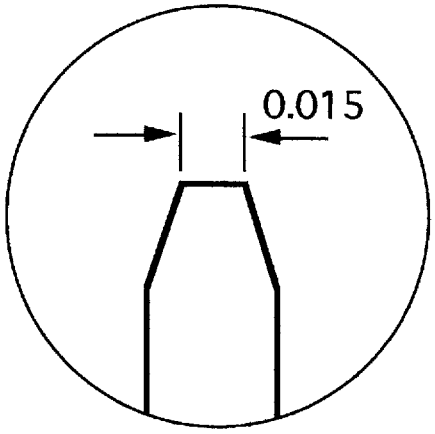
FIG. 2E
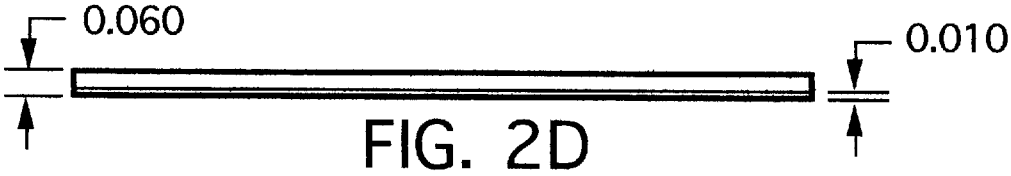
FIG. 2D

NOVELTY ICE SCRAPER

REFERENCE TO RELATED APPLICATION

The present application claims priority of provisional application U.S. Ser. No. 60/010,820, filed Jan. 30, 1996.

FIELD OF THE INVENTION

The present invention relates to ice scraper devices for use on automobile windshields.

BACKGROUND OF THE INVENTION

Ice scraper devices for use on automobile windshields typically carry at least one scraping edge which is used to remove frost and ice deposited on the windshield. The scraping edge is typically smooth, i.e., not jagged or broken. An additional scratching edge can be provided on the device which can be used to dig into larger ice accumulations on the windshield to break up the ice into smaller deposits for removal with the scraper edge. The scraper device needs to be large enough to be held conveniently in a user's hand and sturdy enough to be effective in removing the ice. However, the device should not be so unwieldy or excessively bulky that its portability is compromised.

Some people confronted with small brittle ice deposits and/or snow deposits on their automobile windshield improvise by using a standard plastic wallet card, e.g., a credit card, as a rudimentary scraping device. Not only is it likely that the plastic card can become permanently damaged as a result, but the card is generally not very effective in removing ice deposits of any significance. One proposal along these lines is disclosed in U.S. Pat. No. 5,445,420.

Other approaches to the problem employ larger, more substantial devices, which may provide a handle, squeegee, and/or brush feature. Various proposals are disclosed by U.S. Pat. Nos. 4,275,476; 4,418,439; 4,468,831; 4,712,269; 4,747,175; 4,809,386; 4,922,569; and 5,263,222. Ice scraping devices with plural scraping edges have also been disclosed in U.S. Pat. Nos. 5,418,998 and 5,099,540.

An ice scraper having two types of edges, one being a smooth beveled edge and the other having a plurality of elevated ridges, attached to a handle is described in U.S. Pat. No. 4,719,660. A similar device disclosed in U.S. Pat. No. 4,813,458 provides a scraping blade and scraping teeth on opposing faces of the device in combination with a handle. Yet another device has toothed rollers or disks to break up the ice prior to scraping is disclosed in U.S. Pat. No. 4,546,513.

However, none of the above devices is conveniently planar and palm-sized, and having a scraping edge juxtaposed with a scratching edge, which can be used synergistically to remove larger ice deposits.

SUMMARY OF THE INVENTION

The present invention is for an ice scraper, which is small enough to fit comfortably in the palm of a person's hand, or in a wallet, purse, or shirt pocket. It also has at least one substantially flat surface onto which an advertising message, company logo, and the like, can be imprinted. The cost of the device is low enough that it can be exchanged as a novelty item, promotional product, etc.

A device of the invention is provided with a saw-toothed shaped scratching edge proximate a beveled scraping edge. The device is conveniently about the size of a credit card.

BRIEF DESCRIPTION OF THE DRAWINGS

FIG. 2A shows a more detailed view of a preferred embodiment of the invention. FIGS. 2B and 2C depict alternative crosssectional views taken along line 2B—2B in FIG. 2A. FIG. 2D shows an edge-on view of the beveled edge shown in FIG. 2B. FIG. 2E shows an expanded view of the beveled edge shown in FIG. 2C.

DETAILED DESCRIPTION OF THE INVENTION

Figure 1A:
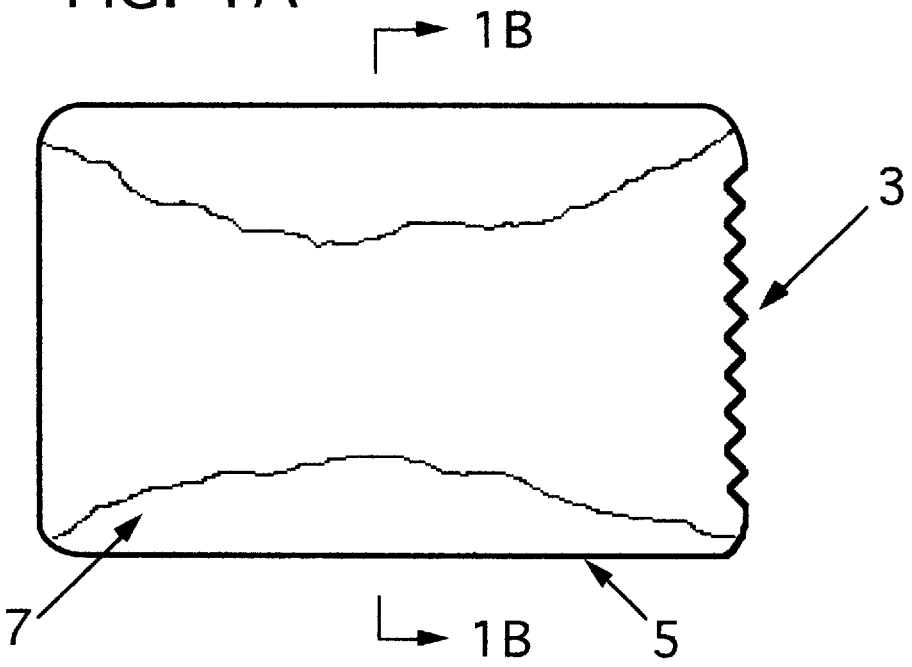
FIGS. 1A presents a plan view of an ice scraper of the invention.
Figure 1B:
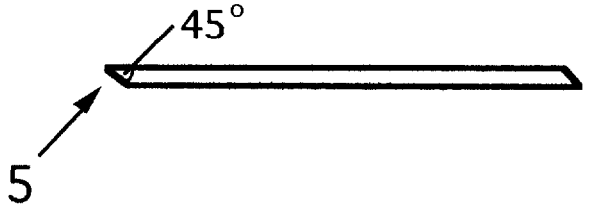
FIG. 1B depicts a cross-sectional view of the device shown in FIG. 1A taken along line 1B—1B in FIG. 1A.

A preferred embodiment of the invention is shown in FIGS. 1A and 1B. Thus, substantially planar device 1 is provided with a saw-tooth (serrated) edge 3 for cutting and scratching ice, e.g., from a windshield. Also, at least one beveled edge 5 is provided proximate saw-tooth edge 3 for scraping away frost and dislodged ice. In a preferred embodiment as shown in FIG. 1B, two beveled edges are provided proximate the saw-toothed edge, in which the edges make about a 45° angle from one face of the device.

The overall dimensions of device 1 are approximately those of a standard credit card, i.e., 2⅛"×3⅜", however, the thickness of the device is somewhat greater than for a credit card in order to increase its ruggedness. A preferred thickness is about double that for a credit card, i.e., 60+/−30 mils.

The beveled edge can be provided in either right-hand or left-hand orientation related to the saw-toothed edge. That is, the beveled edge can be provided relative to the saw-tooth edge so that the user does not have to reorient the device between scratching and scraping operations. As discussed hereinbelow, the necessity to reorient the device can be avoided particularly whenever a double bevel is provided along the scraping edge.

In the embodiment shown in FIG. 2A, the teeth of the sawtoothed edge are about 0.10 inch in length and are provided linearly along the edge at a repeat distance of about 0.20 inch. The bevel angle of the beveled edge ranges from about 30° to 90°, and preferably is in the range of 45°+/−15°.

As shown in FIG. 2A, the device can be provided with a hole through which a key ring or display rack ring can be inserted. In this case, the diameter of the hole is preferably about 0.15 to 0.25 inch in diameter.

Generally, in order to provide a smooth edge for scraping, a device of the invention is provided with a flattened tip, i.e., perpendicular to the plane of the device, along the beveled edge of the device. This facilitates manufacture and increases the durability of the device. This feature is shown in more detail in FIGS. 2B–2E.

Thus, the 40° beveled edge shown in FIG. 2B has been flattened at its tip to a width of about 10 mil as shown in FIG. 2D. Similarly, the double-beveled edge (at 18+/−50) shown in FIG. 2C is flattened along its tip to a width of about 15 mil as shown in FIG. 2E.

The present device can be made conveniently in small quantities by machining it from a selected sheet of plastic. Alternatively, when large quantities are desired, one method of manufacture is by injection molding. A particularly preferred method entails lamination of two plastic sheets, which can then be cut to form. Preferred plastics are polyester, polyvinyl chloride (PVC), polycarbonate, and ABS, with PVC particularly preferred.

Since the surface of the device is substantially planar, an image can be imprinted conveniently thereon. This is shown in FIG. 1A where a design 7 has been provided. The image is preferably imprinted onto the device using a printing method employed in imprinting credit cards, e.g., embossing. However, due to the higher cost of embossing and the difficulty of embossing cards thicker than a credit card, a dye sublimation technique can be employed by which a desired image is heat transferred onto the body of the plastic substrate. Alternatively, silkscreening techniques, offset printing, and ultraviolet methods can be used. The device can be further provided with a magnetic strip if desired on which data can be stored. The surface of the device can be laminated with plastic to protect it from scratches.

Accordingly, a preferred method of manufacturing an ice scraper of the invention entails laminating together at least two plastic sheets, e.g., two standard 0.030 inch white vinyl sheets. Then any lettering, logos, borders, and the like, desired for the face of the card are applied, e.g., by silk-screening. Alternatively, the imprinting can be personalized or customized by printing on it with an ink-jet printer. The device is then sealed, e.g., heat sealed with a clear vinyl laminate, to protect the imprinted design. The laminated sheet is then fused by applying conventional heat and pressure conditions thereto, and a blank is punched out of the laminate, e.g., with a press punch. The punch is shaped so that a serrated edge is provided on the blank. A keyring hole can also be provided at this point if desired. The blank is then provided with a beveled edge by machining it so as to provide a continuous edge thereto, or preferably by leaving a flattened tip to the beveled edge. The machining step can be repeated as needed to provide double beveling to an edge or to provide more than one beveled edge to the device.

An alternative manufacturing method entails laminating together two plastic sheets, e.g., using colored plastic, then punching out the laminate to provide teeth thereto. The blanks are then beveled any number of times as needed to provide the desired scraping edge(s). Then an adhesive label is applied to a face of the scraper card, which label contains desired lettering, logos, borders, and the like. A clear protective laminate can then be applied if desired.

Although the present invention has been discussed with reference to examples for purposes of clarity and understanding, it should be apparent to one skilled in the art that other embodiments can be practiced within the scope of the appended claims and their equivalents.

What is claimed is:

1. A substantially planar ice scraper having a serrated scratching edge and a beveled scraping edge proximate thereto, which is about the size of a credit card, wherein the beveled scraping edge is provided with a flattened tip.

2. The ice scraper of claim 1, wherein opposing beveled scraping edges are provided proximate the serrated scratching edge.

3. The ice scraper of claim 1, wherein the ice scraper has a thickness of about 60 mils.

4. The ice scraper of claim 1, wherein teeth of the serrated scratching edge have a repeat distance of about 0.20 inch.

5. The ice scraper of claim 1, wherein the beveled scraping edge is double-beveled.

6. A method of manufacturing a substantially planar ice scraper having a serrated scratching edge and a beveled scraping edge proximate thereto, comprising laminating two plastic sheets, fusing the laminate by applying heat and pressure thereto, pressing out a blank from the fused sheet to form said serrated edge, and providing said beveled edge to the blank.

7. The method of claim 6, further comprising, after performing said laminating step, imprinting a design on a face of the laminated sheets and sealing the imprinted laminated sheets with a clear laminate.

* * * * *